US006158607A

United States Patent [19]

Wallberg

[11] Patent Number: 6,158,607

[45] Date of Patent: Dec. 12, 2000

[54] STORAGE CONTAINER WITH ATTACHABLE LID

[76] Inventor: John L. Wallberg, 4806 S. 4180 West, Kearns, Utah 84118

[21] Appl. No.: 09/090,174

[22] Filed: Jun. 4, 1998

[51] Int. Cl.[7] ..... B65D 55/00

[52] U.S. Cl. ..... 220/212; 220/379; 220/780; 220/793

[58] Field of Search ..... 220/23.86, 23.6, 220/212, 212.5, 780, 781, 793, 792, 796, 805, 802, 380, 379, 794, 4.27; 206/501, 514, 515, 503, 508, 509

[56] References Cited

U.S. PATENT DOCUMENTS

| | | | |
|---|---|---|---|
| 1,778,175 | 10/1930 | Thune | 220/212 X |
| 2,695,115 | 11/1954 | Roop | 220/802 |
| 3,079,037 | 2/1963 | Schechter | 220/212 |
| 3,107,028 | 10/1963 | Robertis | 220/212 |
| 3,123,246 | 3/1964 | Spinoza | 220/212 |
| 3,355,056 | 11/1967 | Fisch | 220/802 |
| 4,762,248 | 8/1988 | Uhlig | 206/508 |
| 4,921,114 | 5/1990 | Rome | 220/212 |
| 4,951,832 | 8/1990 | Tenney et al. | 220/212 X |
| 5,409,128 | 4/1995 | Mitchell | 220/23.6 X |
| 5,507,407 | 4/1996 | Feer et al. | 220/793 X |
| 5,586,656 | 12/1996 | Abrums | 220/212 X |
| 5,692,617 | 12/1997 | Adams | 220/212 X |
| 5,769,229 | 6/1998 | Andress et al. | 206/508 X |
| 5,799,792 | 9/1998 | Abrums | 220/212 |
| 5,868,268 | 2/1999 | Walker | 206/509 X |

*Primary Examiner*—Nathan J. Newhouse

[57] ABSTRACT

A new storage container with attachable lid for preventing the lid from being lost when removed from the container. The inventive device includes a container having a generally cylindrical configuration. The container has an open upper end, a closed lower end, and a cylindrical side wall therebetween. A lid portion is adapted for selective snap engagement to both the open upper end and the closed lower end of the container.

6 Claims, 3 Drawing Sheets

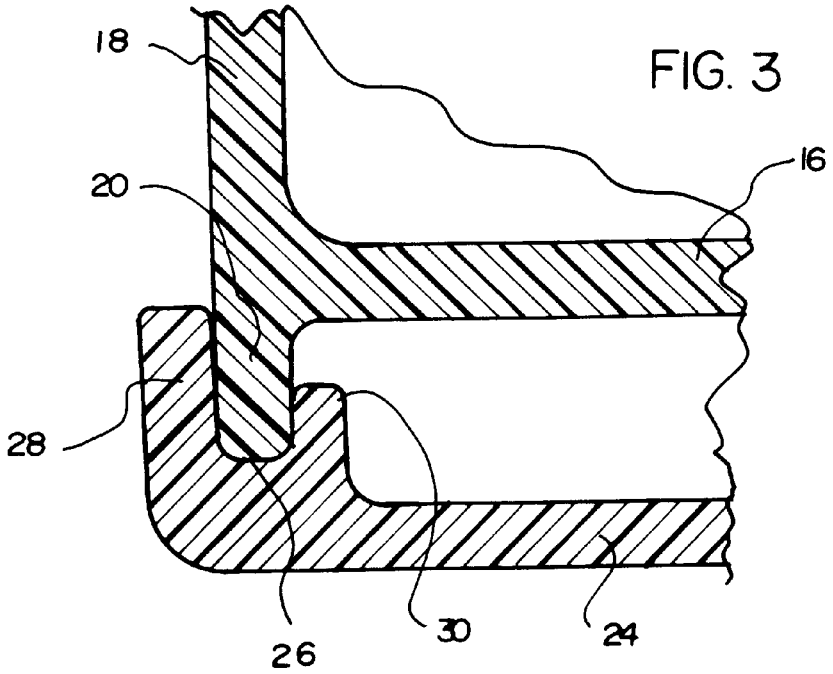
FIG. 3
FIG. 4
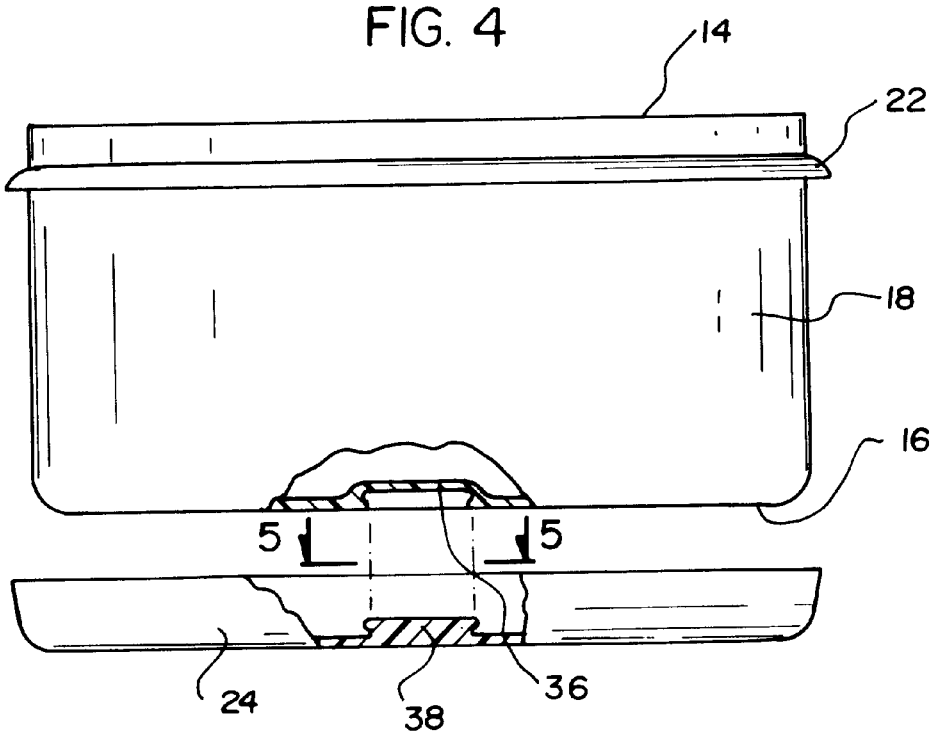

STORAGE CONTAINER WITH ATTACHABLE LID

BACKGROUND OF THE INVENTION

1. Field of the Invention

The present invention relates to container covers and more particularly pertains to a new storage container with attachable lid for preventing the lid from being lost when removed from the container.

2. Description of the Prior Art

The use of container covers is known in the prior art. More specifically, container covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art container covers include U.S. Pat. No. 3,954,178 to Mason, Jr.; U.S. Pat. No. 2,429,958 to Liebmann; U.S. Pat. No. 3,091,361 to Gawron; U.S. Pat. No. 5,447,249 to Vickers; U.S. Pat. No. 5,244,106 to Takacs; and U.S. Pat. No. Des. 336,613 to Zutler.

While these devices fulfill their respective, particular objectives and requirements, the aforementioned patents do not disclose a new storage container with attachable lid. The inventive device includes a container having a generally cylindrical configuration. The container has an open upper end, a closed lower end, and a cylindrical side wall therebetween. A lid portion is adapted for selective snap engagement to both the open upper end and the closed lower end of the container.

In these respects, the storage container with attachable lid according to the present invention substantially departs from the conventional concepts and designs of the prior art, and in so doing provides an apparatus primarily developed for the purpose of preventing the lid from being lost when removed from the container.

SUMMARY OF THE INVENTION

In view of the foregoing disadvantages inherent in the known types of container covers now present in the prior art, the present invention provides a new storage container with attachable lid construction wherein the same can be utilized for preventing the lid from being lost when removed from the container.

The general purpose of the present invention, which will be described subsequently in greater detail, is to provide a new storage container with attachable lid apparatus and method which has many of the advantages of the container covers mentioned heretofore and many novel features that result in a new storage container with attachable lid which is not anticipated, rendered obvious, suggested, or even implied by any of the prior art container covers, either alone or in any combination thereof.

To attain this, the present invention generally comprises a container having a generally cylindrical configuration. The container has an open upper end, a closed lower end, and a cylindrical side wall therebetween. The closed lower end has a peripheral lip extending downwardly therefrom. The cylindrical side wall has a peripheral flange extending outwardly therefrom downwardly of the open upper end. A lid portion is adapted for selective snap engagement to both the open upper end and the closed lower end of the container. The lid portion includes an outer peripheral channel defined by downwardly extending inner and outer walls. The peripheral channel selectively couples with the open upper end of the container and the peripheral lip of the closed lower end of the container. The outer wall has a tab extending downwardly therefrom. A free end of the tab has an arcuate recess formed therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new storage container with attachable lid apparatus and method which has many of the advantages of the container covers mentioned heretofore and many novel features that result in a new storage container with attachable lid which is not anticipated, rendered obvious, suggested, or even implied by any of the prior art container covers, either alone or in any combination thereof.

It is another object of the present invention to provide a new storage container with attachable lid which may be easily and efficiently manufactured and marketed.

It is a further object of the present invention to provide a new storage container with attachable lid which is of a durable and reliable construction.

An even further object of the present invention is to provide a new storage container with attachable lid which is susceptible of a low cost of manufacture with regard to both materials and labor, and which accordingly is then susceptible of low prices of sale to the consuming public, thereby making such storage container with attachable lid economically available to the buying public.

Still yet another object of the present invention is to provide a new storage container with attachable lid which provides in the apparatuses and methods of the prior art some of the advantages thereof, while simultaneously overcoming some of the disadvantages normally associated therewith.

Still another object of the present invention is to provide a new storage container with attachable lid for preventing the lid from being lost when removed from the container.

Yet another object of the present invention is to provide a new storage container with attachable lid which includes a container having a generally cylindrical configuration. The container has an open upper end, a closed lower end, and a cylindrical side wall therebetween. A lid portion is adapted for selective snap engagement to both the open upper end and the closed lower end of the container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view of the present invention as taken along line 3—3 of FIG. 2.

FIG. 4 is a side view of an alternate embodiment of the present invention.

DESCRIPTION OF THE PREFERRED EMBODIMENT

Figure 1:
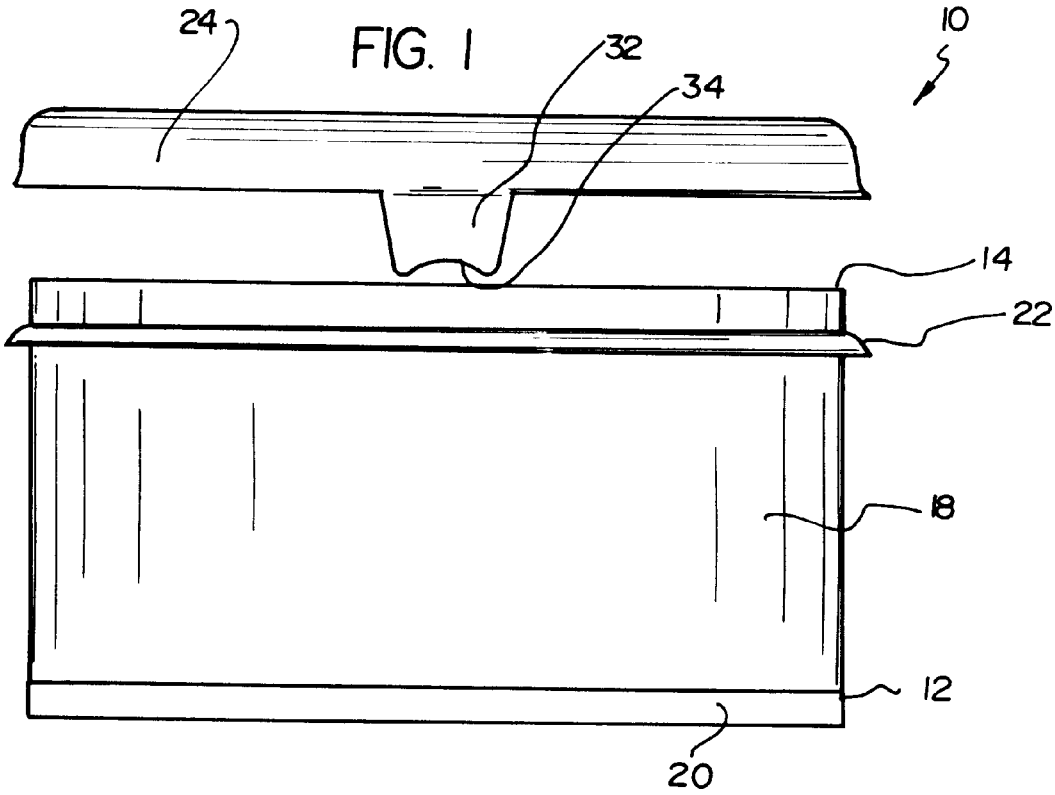
FIG. 1 is a side view of a new storage container with attachable lid according to the present invention.
Figure 2:
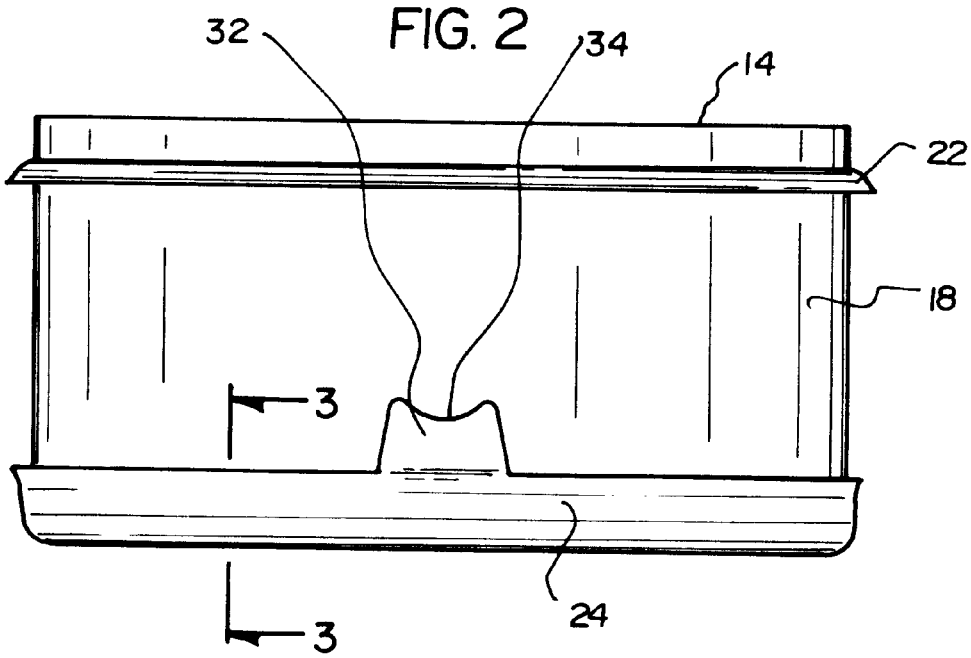
FIG. 2 is a side view of the present invention illustrated with the lid attached to the bottom of the container.

With reference now to the drawings, and in particular to FIGS. 1 through 6 thereof, a new storage container with attachable lid embodying the principles and concepts of the present invention and generally designated by the reference numeral 10 will be described.

As best illustrated in FIGS. 1 through 6, the storage container with attachable lid 10 comprises a container 12 having a generally cylindrical configuration. The container 12 has an open upper end 14, a closed lower end 16, and a cylindrical side wall 18 therebetween. The closed lower end 16 has a peripheral lip 20 extending downwardly therefrom. The cylindrical side wall 18 has a peripheral flange 22 extending outwardly therefrom downwardly of the open upper end 14.

A lid portion 24 is adapted for selective snap engagement to both the open upper end 14 and the closed lower end 16 of the container 12. The lid portion 24 includes an outer peripheral channel 26 defined by downwardly extending inner and outer walls 28,30. The peripheral channel 26 selectively couples with the open upper end 14 of the container 12 and the peripheral lip 20 of the closed lower end 16 of the container 12. The outer wall has a tab 32 extending downwardly therefrom. A free end of the tab 32 has an arcuate recess 34 formed therein.

Figure 5:
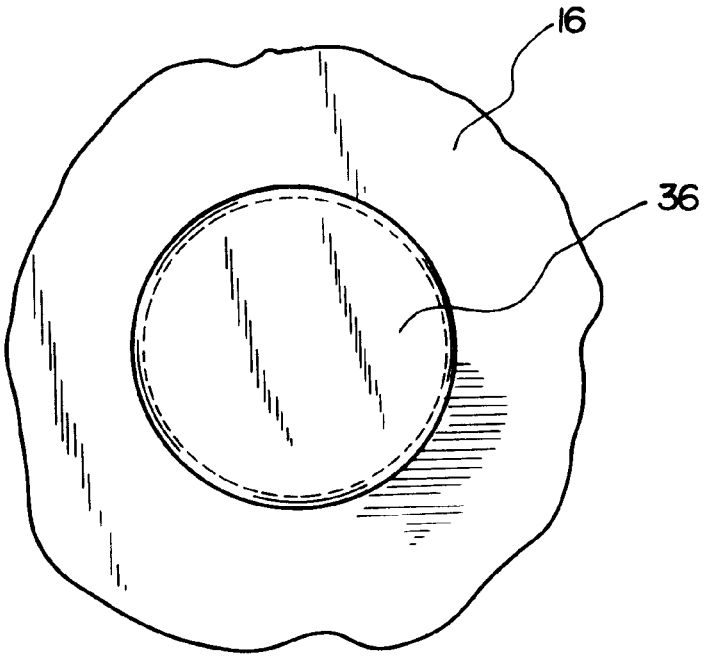
FIG. 5 is a plan view of the present invention as taken along line 5—5 of FIG. 4.
Figure 6:
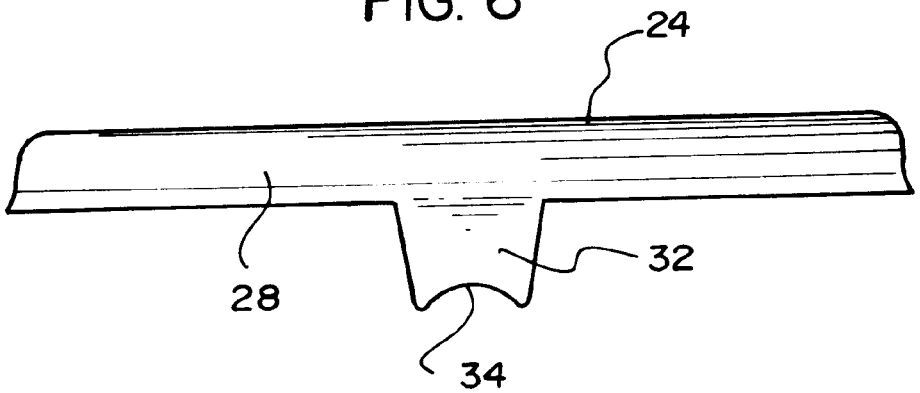
FIG. 6 is a side view of the lid of the present invention.

In an alternate embodiment, as illustrated in FIGS. 4 and 5, the peripheral lip 20 of the container 12 is replaced by an annular recess 36 formed within a central portion of the closed lower end 16 of the container 12. The lid portion 24 has a corresponding annular protrusion 38 extending outwardly of an inner surface thereof for engaging the annular recess 36 when the lid portion 24 is disengaged from the open upper end 14 of the container 12.

In use, the present invention is a container 12 that would keep the lid portion 24 attached to the appropriate container 12 at all times. The lid portion 24 would be readily available and easily accessible when needed. It would eliminate the seemingly endless search for an appropriate lid for a container 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A storage container system with an attachable lid retainable thereon when the lid is not in use, the system comprising:

a container having a generally cylindrical configuration, the container having an open upper end, a closed lower end, and a cylindrical side wall therebetween, the open upper end heaving an upper peripheral lip extending upwardly therefrom and the closed lower end having a lower peripheral lip extending downwardly therefrom, the upper peripheral lip having a diameter substantially equal to a diameter of the lower peripheral lip, the cylindrical side wall having a peripheral flange extending outwardly therefrom downwardly of the open upper end;

a lid portion adapted for selective snap engagement to both the open upper end and the closed lower end of the container, the lid portion including an upper wall with an outer peripheral channel defined by downwardly extending inner and outer walls, the inner wall protruding from the upper wall a distance less than a distance of protrusion from the upper wall by the outer wall for facilitating cleaning of in interior of the channel, the peripheral channel having a diameter corresponding to the diameters of the upper peripheral lip and the lower peripheral lip for permitting selectively coupling of the lid portion with the upper peripheral lip of the open upper end of the container during use of the lid portion and the lower peripheral lip of the closed lower end of the container during periods of non-use of the lid portion, the outer wall of the lid portion having a tab extending downwardly from an edge of the outer wall, a free end of the tab having an arcuate concave recess in the profile of tile free end for permitting a convex surface of a user's finger to rest more securely on the free end of the tab.

2. A storage container system with an attachable lid retainable thereon when the lid is not in use, the system comprising:

a container having a generally cylindrical configuration, the container having an open upper end, a closed lower end, and a cylindrical side wall therebetween, the open upper end having an upper peripheral lip extending upwardly therefrom and the closed lower end having a lower peripheral lip extending downwardly therefrom, tile upper peripheral lip having a diameter substantially equal to a diameter of the lower peripheral lip;

a lid portion adapted for selective snap engagement to both the open upper end and the closed lower end of the container, the lid portion including an upper wall with an outer peripheral channel defined by downwardly extending inner and outer walls, the peripheral channel having a diameter corresponding to the diameters of tile upper peripheral lip and the lower peripheral lip for permitting selectively coupling of the lid portion with the upper peripheral lip of the open upper end of the container during use of the lid portion and the lower peripheral lip of the closed lower end of the container during periods of non-use of the lid portion;

wherein the lid portion has a tab extending downwardly therefrom; and wherein a free end of the tab has an arcuate recess in the profile of the free end for permitting a convex surface of a user's finger to rest more securely on the free end of the tab.

3. The storage container with attachable lid as set forth in claim 2 wherein the inner wall protrudes from the upper wall a distance less than a distance of protrusion from the upper wall by the outer wall for facilitating cleaning of in interior of the channel.

4. The storage container with attachable lid as set forth in claim 2 wherein the cylindrical side wall has a peripheral flange extending outwardly therefrom downwardly of the open upper end.

5. A storage container system with an attachable lid retainable thereon when the lid is not in use, the system comprising a container having a generally cylindrical configuration, the container having an open upper end, a closed lower end, and a side wall extending between the upper and lower ends, the open upper end having an upper peripheral lip extending upwardly therefrom;

a lid portion adapted for selective snap engagement to both the open upper end and the closed lower end of the container, the lid portion including an outer peripheral channel defined by downwardly extending inner and outer walls, the peripheral channel being adapted for selectively coupling with the upper peripheral lip of the open upper end of the container during use of the lid portion.

wherein the closed lower end of the container has an annular recess formed in a central portion of a lower outer surface of the closed lower end, the annular recess having an annular lip extending into the recess to create a groove in the recess, the lid portion having a corresponding annular protrusion extending outwardly of an inner surface of the lid portion, the annular protrusion having an annular lip adapted for releasable insertion into the groove of the annular recess for engaging the lid portion to the closed lower end of the container when the lid portion is disengaged from the open upper end of the container; and wherein the annular recess has a diameter and the side wall has a diameter;

wherein the outer wall of the lid portion has a tab extending downwardly from an edge of the outer wall, a free end of the tab having an arcuate concave recess in the profile of the free end for permitting a convex surface of a user's finger to rest more securely on the free end of the tab.

6. The storage container system of claim 5 wherein the annular lip on the annular protrusion of the lid portion extends from the protrusion in a direction generally parallel to the inner surface of the lid portion.

* * * * *